US007337774B2

(12) United States Patent
Webb

(10) Patent No.: US 7,337,774 B2
(45) Date of Patent: Mar. 4, 2008

(54) PROJECTILE FIRING DEVICE USING LIQUIFIED GAS PROPELLANT

(75) Inventor: Roger Clyde Webb, Tasmania (AU)

(73) Assignee: Poly Systems Pty Ltd., Tasmania (AU)

( * ) Notice: Subject to any disclaimer, the term of this patent is extended or adjusted under 35 U.S.C. 154(b) by 110 days.

(21) Appl. No.: 10/494,490

(22) PCT Filed: Nov. 1, 2002

(86) PCT No.: PCT/AU02/01492

§ 371 (c)(1),
(2), (4) Date: Apr. 30, 2004

(87) PCT Pub. No.: WO03/038367

PCT Pub. Date: May 8, 2003

(65) Prior Publication Data

US 2005/0011507 A1 Jan. 20, 2005

(30) Foreign Application Priority Data

Nov. 2, 2001 (AU) ..... PR8659

(51) Int. Cl.
*F41B 11/00* (2006.01)

(52) U.S. Cl. ..... 124/60; 89/8

(58) Field of Classification Search ..... 124/56, 124/58, 59–70; 102/440; 89/8
See application file for complete search history.

(56) References Cited

U.S. PATENT DOCUMENTS 4,211,352 A * 7/1980 Zilka ..... 227/130
4,739,915 A * 4/1988 Cotta ..... 227/10
5,079,987 A * 1/1992 Pate et al. ..... 89/7
5,462,042 A 10/1995 Greenwell
5,497,758 A 3/1996 Dobbins et al.
5,608,179 A * 3/1997 Voecks et al. ..... 89/7

(Continued)

FOREIGN PATENT DOCUMENTS

DE 3733-240 A 4/1988

(Continued)

OTHER PUBLICATIONS

Wikipedia article "Combustion"—section "Combustion of Liquid Fuels" on p. 3 of 5. http://en.wikipedia.org/wiki/Combustion.*

*Primary Examiner*—Timothy D. Collins
(74) *Attorney, Agent, or Firm*—Birch, Stewart, Kolasch & Birch, LLP

(57) ABSTRACT

Rifle (1) comprises barrel (2) and loading means (15) for introducing a projectile from magazine (7) into breech (4). The projectile is propelled by a compressed gas propellant initially stored as a liquid in canister (10). The liquid is heated to a super critical state in chamber (8) by heating element (12) to induce a phase change such that the liquid becomes a highly dense gas. The phase change from liquid to gas provides the energy required to expel the projectile at high velocity from rifle (1), regardless of the ambient temperature. The propellant is preferably $CO_2$ which is heated to 31.06° C. Rifle (1) produces minimal noise and no heat signature, making it suitable for military and stealth purposes. A pistol and launchers for grenades or mortar bombs are also disclosed. Another version can launch low earth orbit satellites or payloads.

24 Claims, 11 Drawing Sheets

U.S. PATENT DOCUMENTS 5,771,621 A * 6/1998 Rogers ..... 42/55
6,055,910 A * 5/2000 Zanakis et al. ..... 102/347
6,619,278 B1 * 9/2003 Lin ..... 124/57
6,668,699 B2 * 12/2003 Russell ..... 89/14.05
2004/0074381 A1 * 4/2004 Smith ..... 89/16

FOREIGN PATENT DOCUMENTS

WO WO 87/07940 A1 12/1987

* cited by examiner

PROJECTILE FIRING DEVICE USING LIQUIFIED GAS PROPELLANT

TECHNICAL FIELD

The present invention relates to a projectile firing device, and more particularly to such a device that uses a propellant that is initially stored in a liquid phase and undergoes a phase change to a "highly dense" gas to effect propulsion of the projectile. The projectile firing device may in number of embodiments relate to a weapon such as a gun, rifle, pistol, grenade or mortar launcher. In another embodiment the projectile firing device may be used as a low earth orbit satellite-launch device.

BACKGROUND

Conventional weapons such as rifles and guns use gunpowder or cordite as the explosive material to propel ammunition. Such explosive materials provide a violent expansion of gases and the liberation of relatively large amounts of thermal energy to achieve propulsion of the ammunition. There are a number of disadvantages associated with such conventional weapons. Firstly, they are highly inefficient in energy transferral from the explosive material to the projectile velocity of the ammunition. In many instances only 20-40% of the energy released by the exploding material is transferred to the projectile velocity.

A number of other disadvantages associated with conventional guns and rifles are the emission of large amounts of thermal energy (heat) and noise that can be easily detected with and without the aid of conventional detection equipment. Also, due to the large amounts of thermal energy being released the barrel and breech of a conventional gun or rifle must be able to withstand high temperatures and therefore are typically made of steel.

There are known guns that utilise a compressed gas, such as carbon dioxide ($CO_2$) to effect propulsion of a projectile. Such arrangements use $CO_2$ in a gaseous state stored in a canister that is removably attached to the gun. Known guns that use such an arrangement are spear guns and paintball guns. However, such arrangements are not suitable for high velocity weapons of the type used for military purposes.

Attempts have been made in the past to heat the gas propellant of gas powered projectile firing devices. U.S. Pat. No. 5,462,042 (Greenwell) describes a $CO_2$ powered paint ball gun in which $CO_2$ is initially stored in a conventional $CO_2$ cartridge. The initial expansion of the chilled $CO_2$ occurs in an expansion chamber in the form of a passage which passes through the hand grip 16 and may be warmed by the heat of a user's hand. This arrangement is to speed up the heating of the $CO_2$ prior to firing of the gun.

German Patent Application DE 3733-240 (Steyr-Daimler-Punch AG) describes a gun using a liquefied gas propellant. The gun has a heater for heating gas as it passes through a tube towards the propellant chamber. The gas is heated on its way to the propellant chamber to enhance precision of the gun by compensating for temperature changes which affect the liquid-gas propellant.

The above described prior art guns utilise heating arrangements that provide heat to the propellant gas prior to it reaching the propellant chamber, in an attempt to overcome firing problems that may occur at colder ambient temperatures. However, these heating arrangements suffer from the disadvantage that they do not ensure reliable repeated firing of a gun over a wide range of cold ambient temperatures.

The present invention seeks to provide a projectile firing device that overcomes the disadvantages associated with conventional weapons and with known gas powered projectile firing devices as described above. It also seeks to provide a means for other projectile firing applications such as launching low earth orbit satellites and payloads.

SUMMARY OF THE INVENTION

According to a first aspect the present invention is a projectile firing device comprising:

an elongate barrel through which a projectile is fired;

loading means for introducing said projectile into said barrel;

said projectile being adapted to be propelled by a compressed gas propellant, characterised in that said compressed gas propellant is initially stored as liquid and adapted to be heated by a heating means which induces a phase change such that said propellant becomes a highly dense gas.

Preferably in one embodiment said device comprises at least one chamber for holding said compressed gas propellant, said chamber being in fluid communication with said barrel via a valve means adapted to release said compressed gas propellant to fire said projectile held in said barrel, and a reservoir located remote from said chamber for storing said propellant in its initial liquid state, and a means for introducing said propellant in its liquid state from said reservoir into said chamber.

Preferably said device is a weapon, such as a rifle, gun or pistol. Preferably said barrel of said weapon is made of a composite material such as KEVLAR/aluminium laminate and metals such as steel, and said barrel has a TEFLON coated bore. Preferably where said device is a rifle it has a body, stock and pistol grip made of plastic, such glass filled nylon.

Alternatively, said device is a satellite-launch device and said projectile is a low earth orbit satellite. Preferably said satellite launch device comprises a plurality of modular units and a plurality of chambers. Preferably each chamber is associated with at least one modular unit.

A projectile firing device as described in any of the abovementioned embodiments wherein said device further comprises an electronic control unit, which controls the ingress of the propellant in its liquid state from the reservoir to said chamber and controls the heating means used to heat said propellant. Preferably where said projectile firing device is a weapon or satellite launching device it further comprises targeting means for targeting said projectile and said electronic control unit is operably connected to said targeting means to control ingress of said propellant to said chamber and to control the heating means used to heat said propellant in response to varying targeting parameters.

In another embodiment of said projectile firing device, said projectile is housed within a cartridge, said cartridge containing a reservoir of propellant in its initial liquid state and a thermal detonator adjacent thereto, said heating means adapted to heat said thermal detonator which in turn heats propellant. Preferably said device is a weapon, such as a grenade launcher.

In a further embodiment of said device, said projectile is housed within a cartridge, said cartridge containing a reservoir of propellant in its initial liquid state and at least a portion of said heating means adapted to heat said propellant is integral with said cartridge. Preferably said cartridge uses a portion of the explosive energy of the propellant to continue acceleration of the projectile for a period of time after the projectile has left said device. Preferably said device is a weapon, such as a mortar launcher.

A projectile firing device as defined in any of the abovementioned embodiments wherein said device further comprises an electronic control unit, which controls the ingress of the propellant in its liquid state from the reservoir to said chamber and controls the heating means used to heat said propellant.

According to a second aspect the present invention comprises a projectile firing device comprising:

an elongate barrel through which a projectile is fired;

loading means for introducing said projectile into said barrel;

at least one chamber for holding a compressed gas propellant, said chamber being in fluid communication with said barrel via a valve means being adapted to release said compressed gas propellant to fire a projectile held in said barrel;

characterised in that said compressed gas propellant is initially a liquid stored in a reservoir remote from said chamber, said propellant in its liquid form being adapted to be introduced into said chamber and heated therein by a heating means that induces a phase change in the propellant from a liquid to a highly dense gas.

Preferably in any of the abovementioned embodiments said propellant is carbon dioxide.

BRIEF DESCRIPTION OF THE DRAWINGS

The invention will now be described with reference to drawings in which.

MODE OF CARRYING OUT INVENTION

Figure 1:
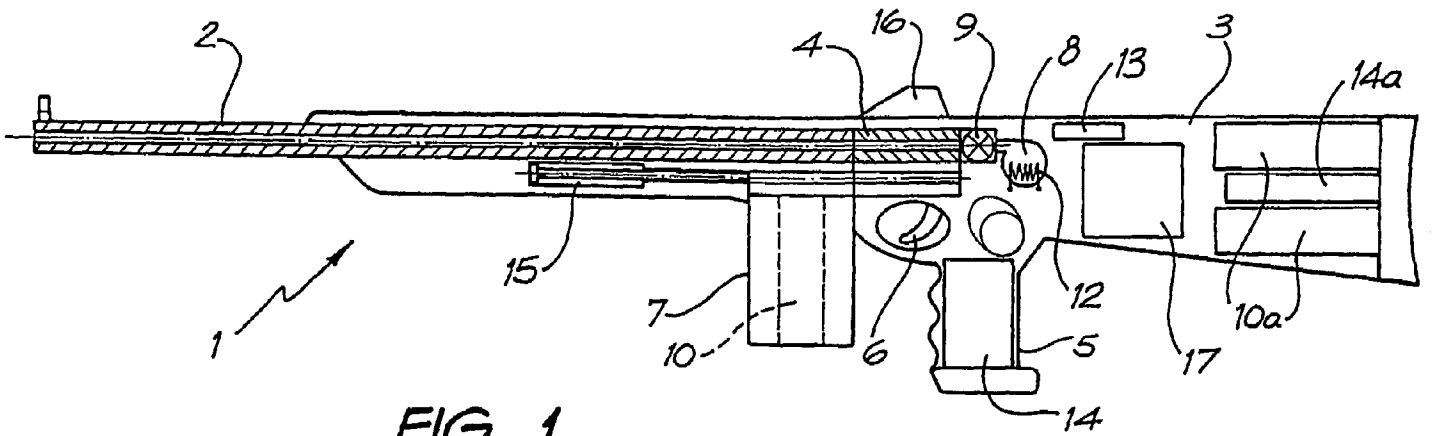
FIG. 1 is a schematic elevational view of a rifle according to a first embodiment of the present invention.
Figure 2:
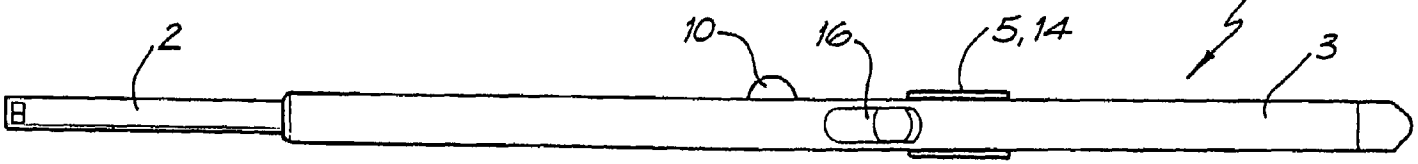
FIG. 2 is a plan view of the rifle shown in FIG. 1.
Figure 4:
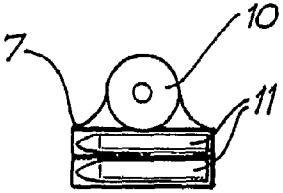
FIG. 4 is a plan schematic of magazine and $CO_2$ cannister of the rifle shown in FIG. 1.
Figure 3:
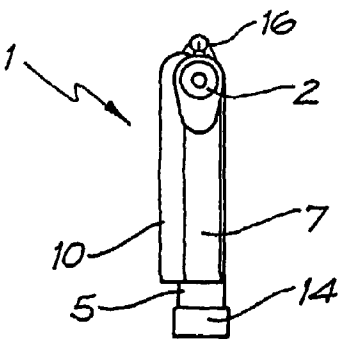
FIG. 3 is an end view of the rifle shown in FIG. 1.
Figure 5:
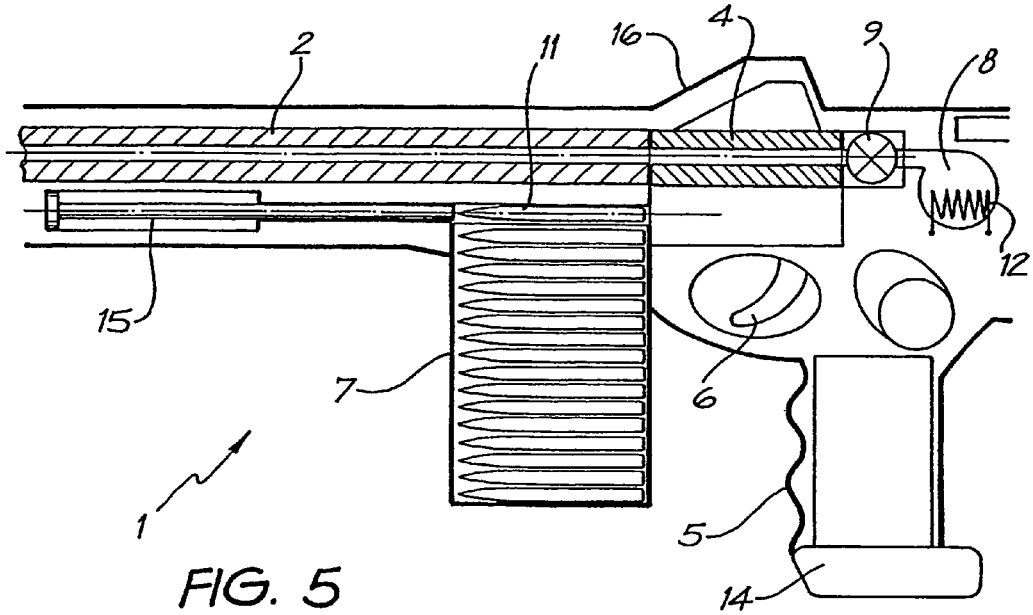
FIGS. 5 to 8 are enlarged partial elevational schematics detailing various stages of loading and firing a projectile in the rifle shown in FIG. 1.

FIGS. 1 to 4 depicts a rifle 1 and its ammunition in accordance with a first embodiment of a projectile firing device of the present invention. In a similar manner to conventional rifles, rifle 1 has a rifled barrel 2, stock 3, breech 4, pistol grip 5, trigger mechanism 6 and removable ammunition magazine 7.

Rifle 1 also has a high-pressure chamber 8 in fluid communication with barrel 2, via a gas lock off-valve 9. A canister 10 containing liquid carbon dioxide ($CO_2$) is integrally housed within magazine 7.

The rifle 1 fires an ammunition projectile 11 loaded into breech 4 in the following manner. The liquid $CO_2$ contained in canister 10 is the propellant used to fire projectile 11. Liquid $CO_2$ is introduced into chamber 8 from canister 10. The fluid communication means between canister 10 and chamber 8 has been omitted from the figures for the purpose of clarity. The liquid $CO_2$ in chamber 8 is heated by a heating element 12 that is powered by an electrical battery power supply 14 housed within pistol grip 5.

When $CO_2$ is heated to 31.06° C., it changes to a "super critical state" which is a "highly dense" gas at high pressure. In this embodiment the critical state of $CO_2$ as it changes phase from liquid to a gas, provides the explosive energy required to expel projectile 11 at high velocity from rifle 1, regardless of the ambient temperature. This explosive process which fires projectile 11, occurs with minimal noise and no heat signature emitting from rifle 1, thereby making rifle 1 advantageous when used for military and stealth purposes.

The following table depicts the temperature/pressure relationship of Liquid/gas $CO_2$.

| Temperature (° C.) | Pressure (bar) | |
|---|---|---|
| 21 | 54 | |
| 31 | 74 | Critical point |
| 100 | 250 | |
| 500 | 1250 | |
| 1000 | 2500 | |

The suitability of $CO_2$ as a preferred propellant can be appreciated by the following:

1 gram of liquid $CO_2$ will liberate to 500 cc of gas at 25° C.

1 gram of $CO_2$=0.759 cc at 25° C.

1 cc of liquid $CO_2$ will liberate to 660 cc at 25° C.

Figure 6:
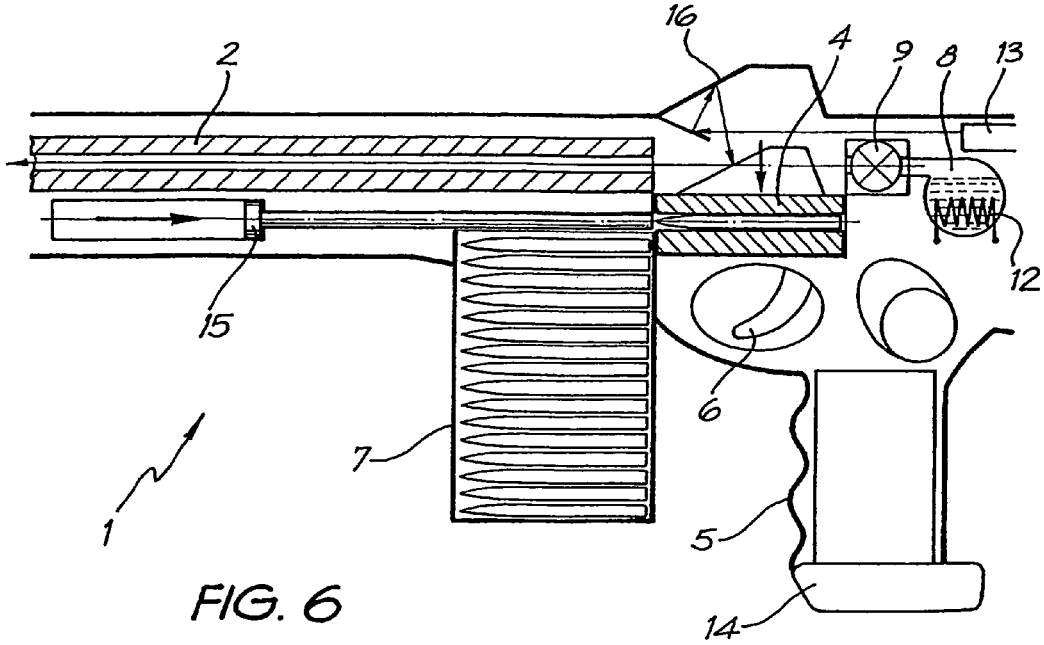

In use rifle 1, operates as follows with reference to FIGS. 5-8. A pneumatic loading mechanism 15 is used to load a projectile 11 contained in magazine 7 into breech 4. When breech 4 is lowered into the loading position as shown in FIG. 6, the targeting system sight module 16 and of a laser sight generator 13 is activated and reflected up barrel 2.

An electronic module or electronic control unit (ECU) 17 is operably connected to sight module 16 and a Global Positioning System (GPS) as well as operably connected to the $CO_2$ supply and chamber 8. ECU 17 adjusts and monitors targeting, $CO_2$ supply and pressures to match the $CO_2$ requirements to that of the distance of the target. In addition the ECU 17 is operably connected to other components within rifle 1 and may control and monitor electric power supply, projectiles and possible communication systems integrated within the rifle.

When a target is acquired by the user of rifle 1, through sight module 16, GPS and targeting information is in view to the user of the rifle 1 via a heads up display within sight module 16. Adjustment of laser positioning and prism angles for target acquisition occurs instantaneously, and target information may preferably be electronically processed via processing devices used for focussing and triangulation of known electronic video or still cameras.

As the targeting system is operational, a metered amount of liquid $CO_2$, say for example 5 cc, is allowed to enter chamber 8. A small current is passed through heating element 12. The heating of the liquid $CO_2$ results in its pressure building up in a fraction of a second.

Figure 7:
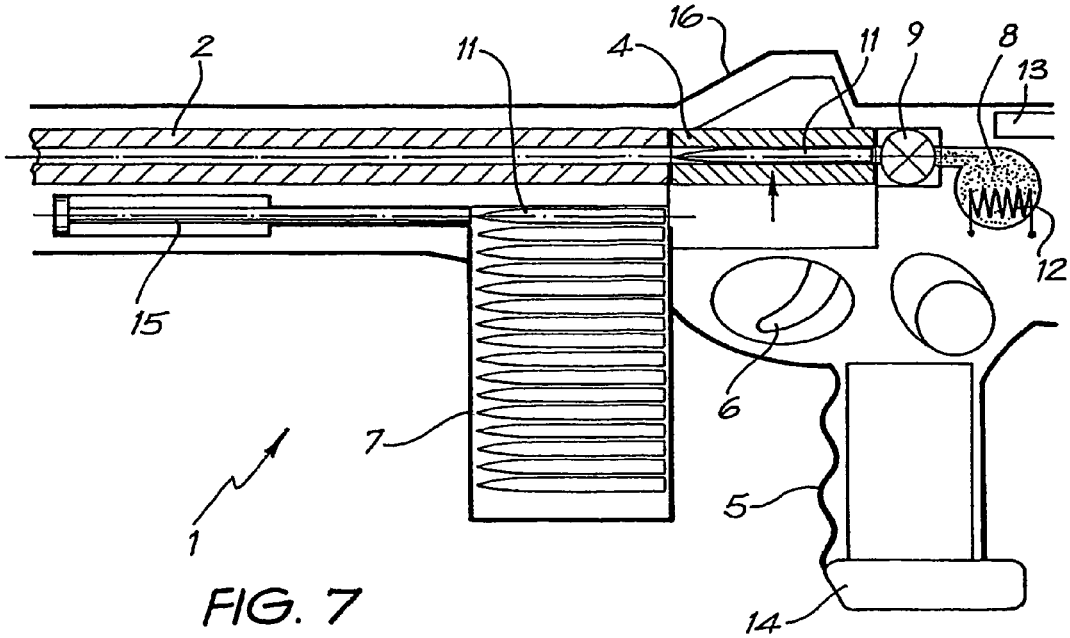
Figure 8:
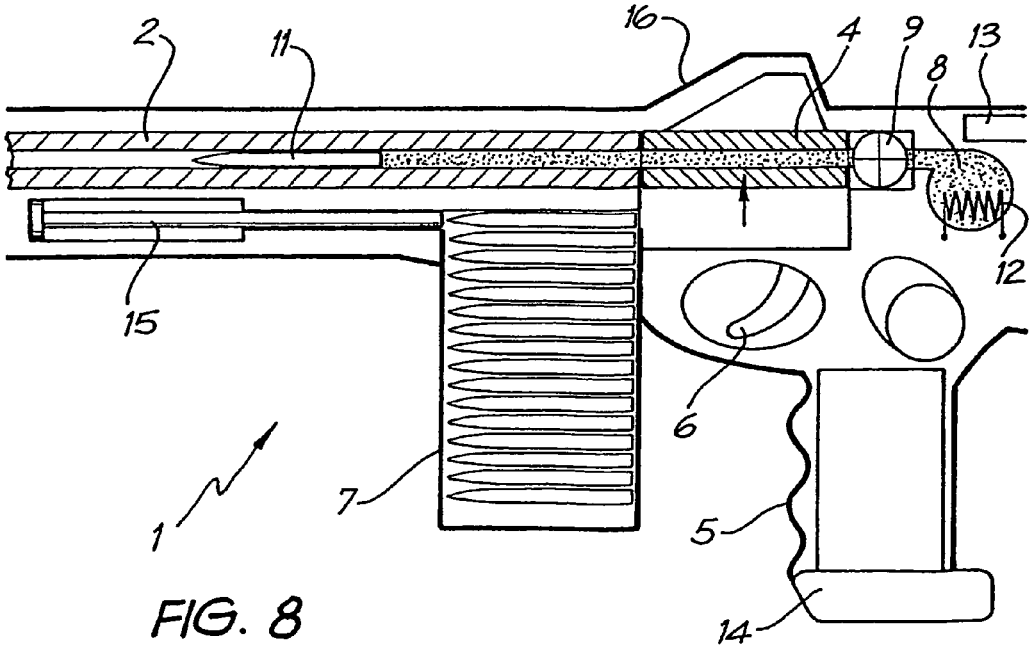

When trigger mechanism 6 is pulled, breech 4 returns to the firing position as shown in FIG. 7. Gas lock-off valve 9 activates the $CO_2$ at the critical state at which it is a highly dense gas and projectile 8 is dispatched at high velocity as shown in FIG. 8.

Preferably as projectile 11 is forced up the bore of barrel 2, the rear of projectile is adapted to flare, to promote a good gas seal. The flaring action promotes a rotational motion from the rifling of barrel 2. Preferably both the barrel 2 and projectile 11 are coated with Teflon to minimize bore wear. Driving bands may also be incorporated to assist spin on projectile 11.

As projectile 11 leaves rifle 1, residual pressure is used to reposition breech 4 to the reload position. The loading mechanism is reactivated and rifle 1 will then regain the target acquisition mode.

Preferably the rifle 1, can be used in a single shot mode, or an automatic mode when the trigger mechanism 6 is left in the fire position.

It should be understood that the various components of rifle 1 can be manufactured from lighter materials than those of conventional rifles, as the explosive release of energy of the $CO_2$ propellant in rifle 1 is more efficient, and therefore a number of the various components of rifle 1 do not have to be of the same material and heat resistant properties as that required in conventional high velocity rifles. For instance the chamber 8 may preferably be manufactured in titanium, stainless steel or aluminum to reduce bulk and to contend with extreme pressures, whilst the major part of the body including stock 3 and pistol grip 5 may preferably be manufactured from injection moulded glass filled nylon. Preferably the barrel 2 is made from an aluminum/KEVLAR laminate material with the bore of barrel 2 being coated with TEFLON and/or chrome-steel.

In addition to the $CO_2$ canister 10 and the battery pack power supply 14, rifle 1 is also equipped with auxiliary $CO_2$ charges 10*a* and a backup battery pack power supply 14*a* contained within stock 3, as shown in FIG. 1.

Preferably breech 4 is an electromagnetic/pneumatic arrangement, with a mechanical override. The breech 4 may be manufactured from aluminum/KEVLAR laminate with a TEFLON coated bore.

The projectiles 11 which are fired from rifle 1 are preferably manufactured with a tip and central core of tungsten. The rear and outer body is made of KEVLAR, which is coated with TEFLON or TEFLON impregnated with carbon. The rear of the projectile is designed to flare and expand under high pressure to ensure a good gas seal, which also promoted projectile rotational motion, from the internal rifling of the bore of barrel 2.

It should be understood that rifle 1 as disclosed above may also be provided with conventional attachment points for a bayonet and hand grenade launcher and sling.

Figure 9:
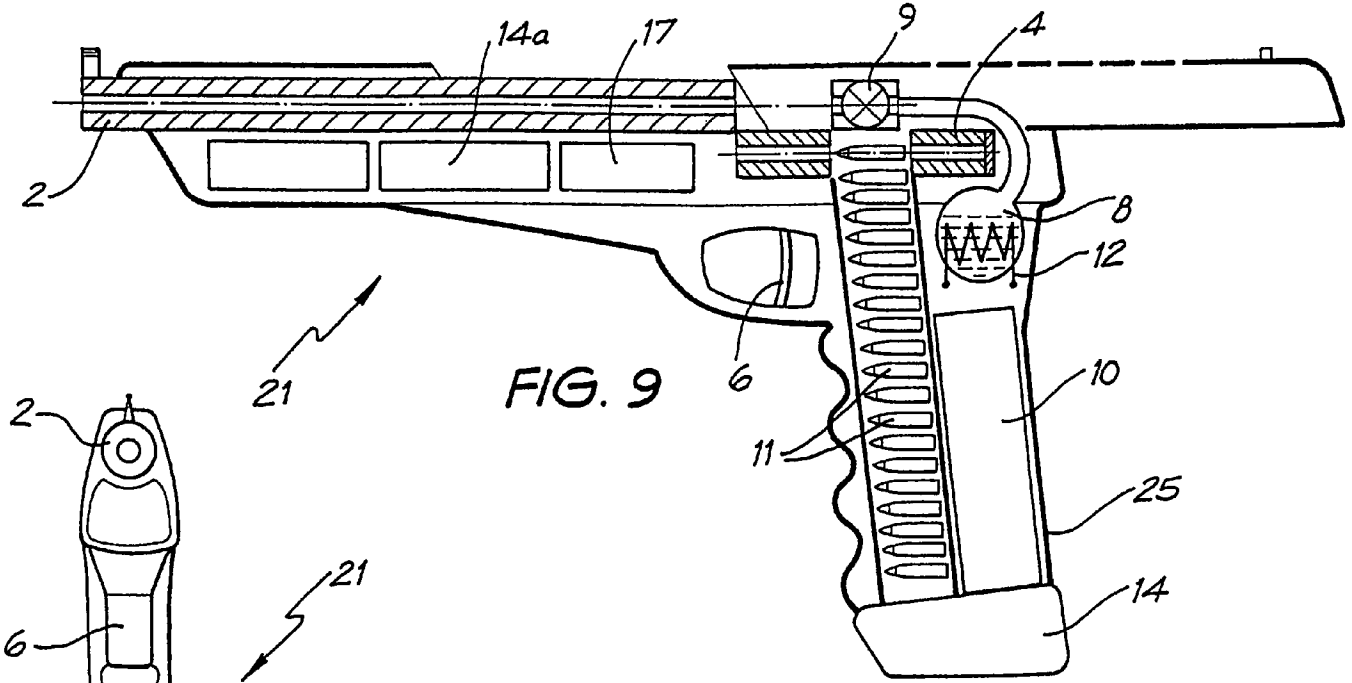
FIG. 9. is a schematic elevational view of a pistol according to a second aspect of the present invention.
Figure 10:
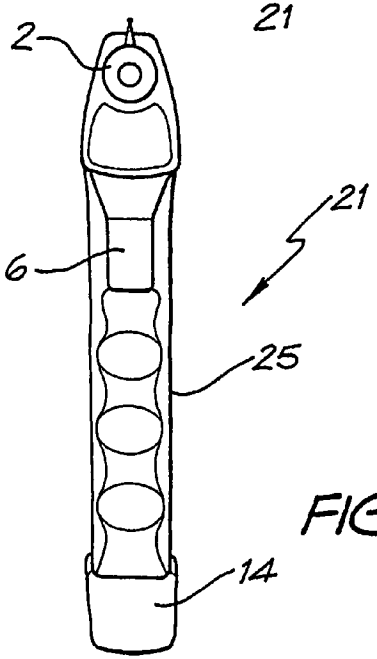
FIG. 10 is an end view of the pistol shown in FIG. 9.

FIGS. 9 and 10 depict a pistol 21 in accordance with a second embodiment of a projectile firing device of the present invention. The pistol 21 like the rifle 1 fires an ammunition projectile 11 loaded into breech 4. In particular, pistol 21 also contains a liquid $CO_2$ canister 10 that is loaded into the pistol grip 25 along with magazine 7 containing projectiles 11. In a like manner to that of rifle 1, liquid $CO_2$ contained within canister 10 is introduced into chamber 8 and may be heated by a heating element 12 that is powered by an electrical battery power supply 14 housed within the body of pistol 21. The dispatch of projectiles 11 occurs in a similar manner to that in rifle 1 in that the liquid $CO_2$ is induced to change its state from a liquid to a "highly dense" gas.

Figure 11:
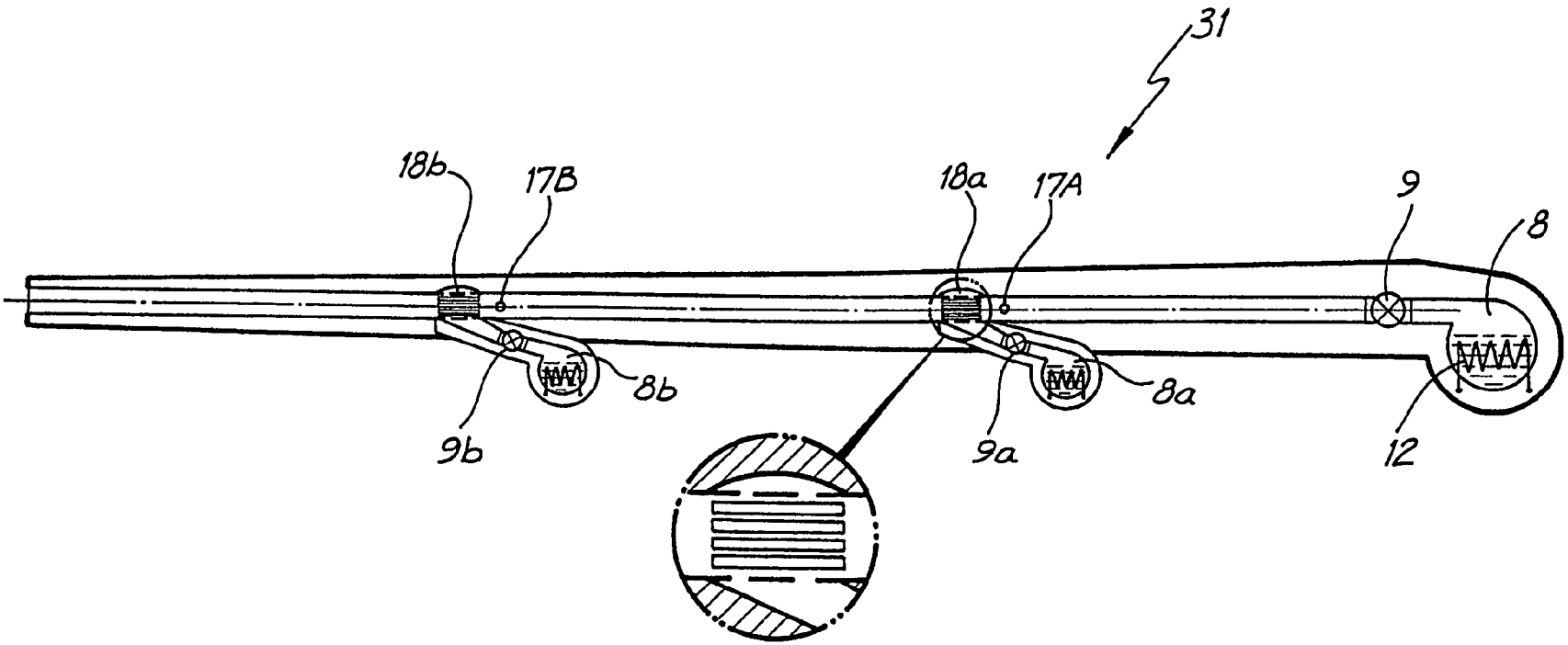
FIG. 11 is a schematic elevational view of a gun according to a third embodiment of the present invention.
Figure 12:
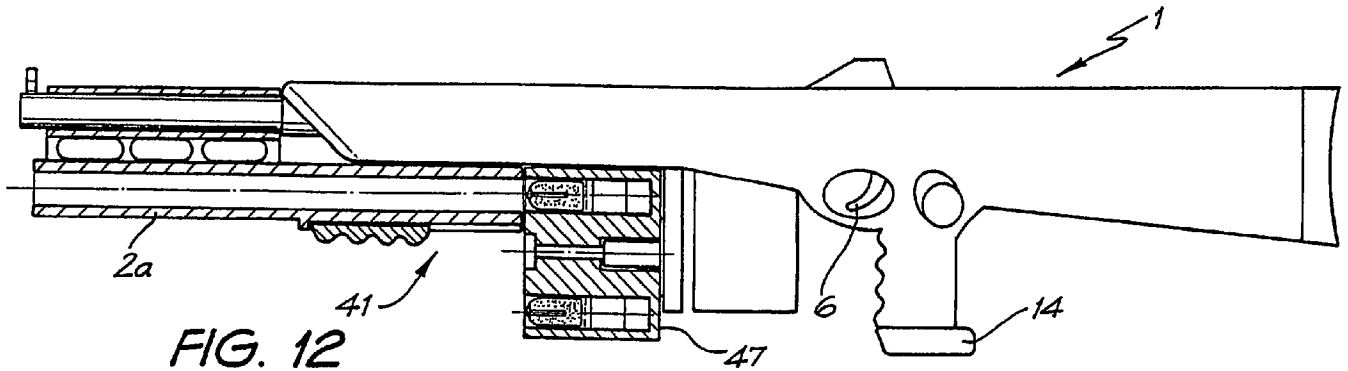
FIG. 12 is a schematic elevational view of a grenade launcher according to a fourth embodiment of the present invention.
Figure 13:
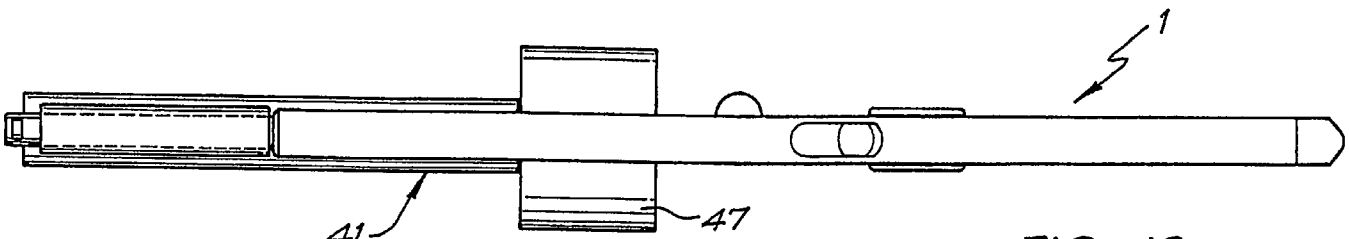
FIG. 13 is a plan view of the grenade launcher shown in FIG. 12.
Figure 15:
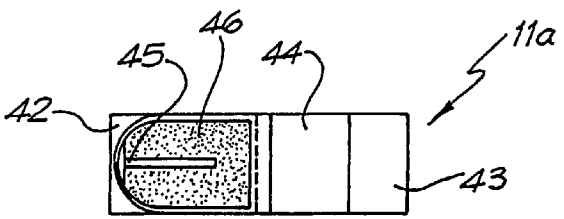
FIG. 15 is an enlarged schematic view of a cartridge used in the grenade launcher of FIG. 12.
Figure 14:
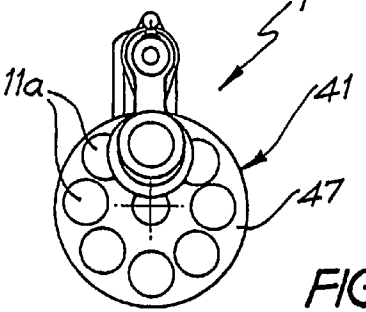
FIG. 14 is an end view of the grenade launcher shown in FIG. 12.
Figure 16:
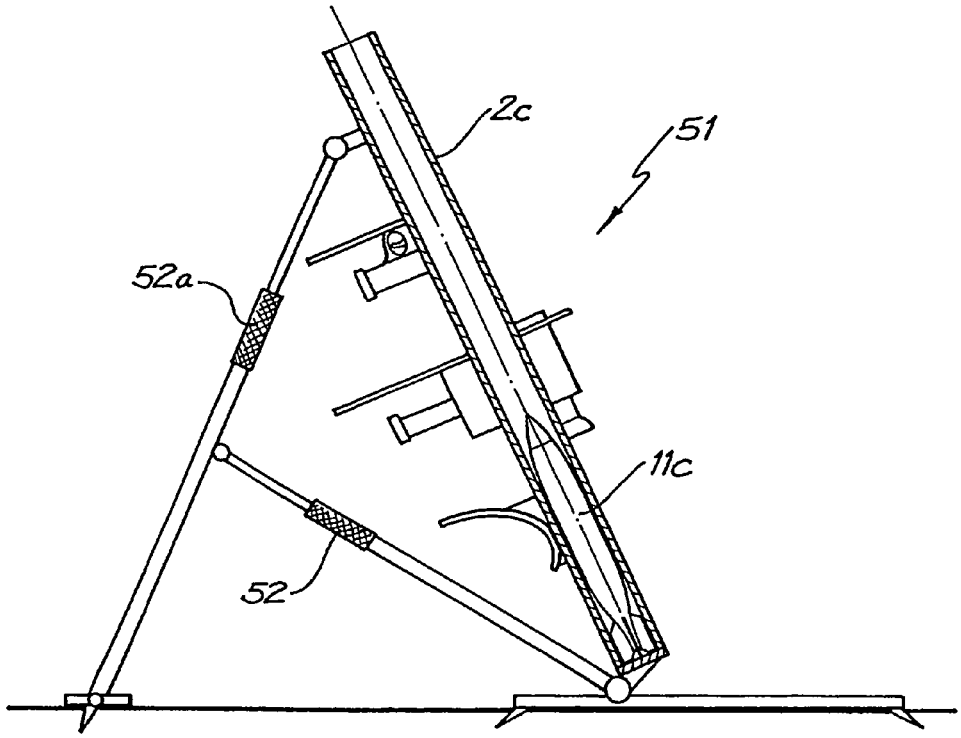
FIG. 16 is a schematic elevational view of a mortar launcher according to a fifth embodiment of the present invention which can be used both by stand and hand held.
Figure 17:
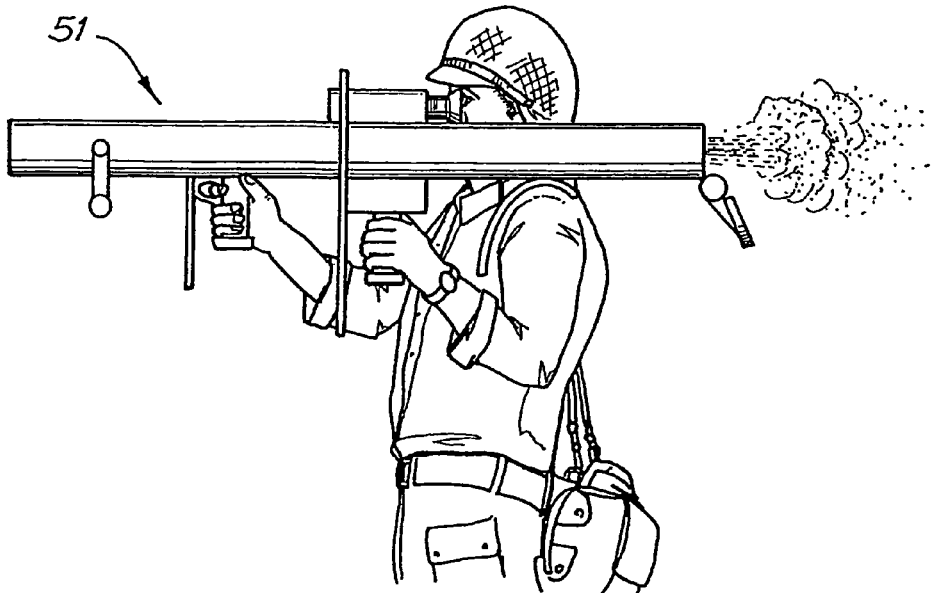
FIG. 17 is an schematic elevational view of a mortar launcher of the mortar of launcher shown in FIG. 16 when in a folded orientation for shoulder use by an infantryman.
Figure 18:
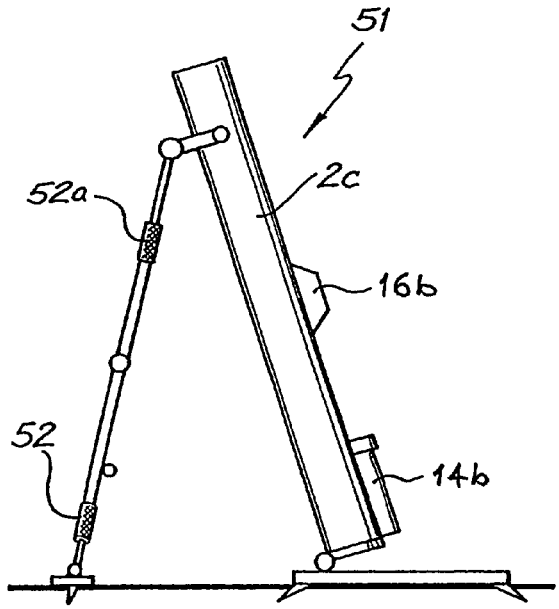
FIG. 18 is a simplified front view the mortar launcher shown in FIG. 16.
Figure 19:
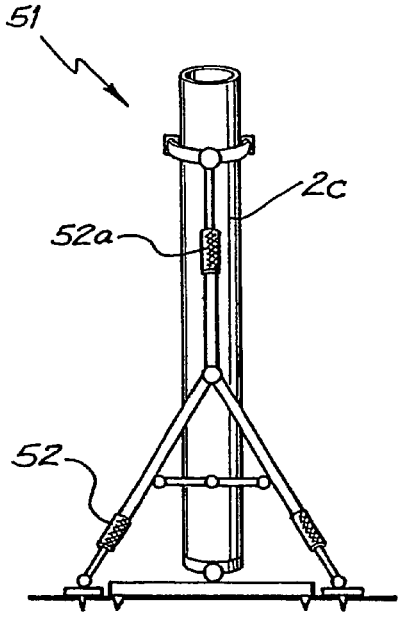
FIG. 19 is a simplified front view the mortar launcher shown in FIG. 18.
Figure 20:
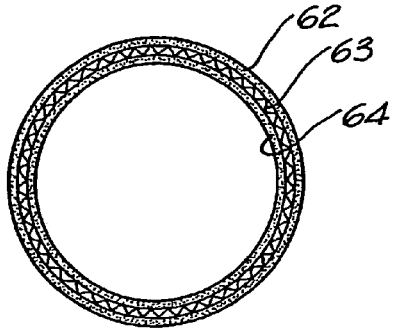
FIG. 20 is a sectional view of the mortar launcher body shown in FIG. 18.
Figure 21:
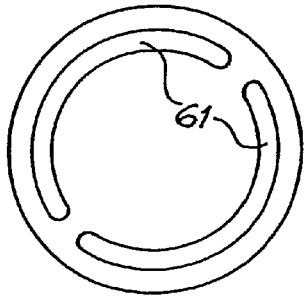
FIG. 21 is a planview of the mortar launcher base shown in FIG. 18.
Figure 22:
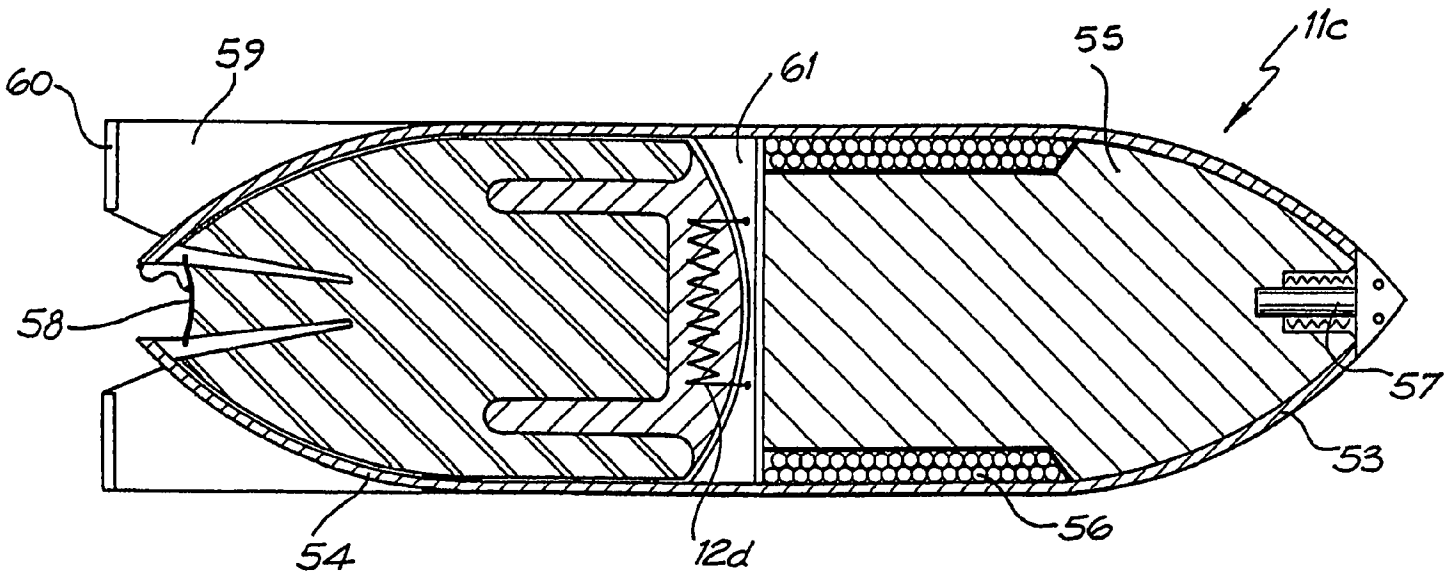
FIG. 22 is an enlarged cross-sectional view of a mortar projectile for the mortar launcher of FIG. 18.
Figure 23:
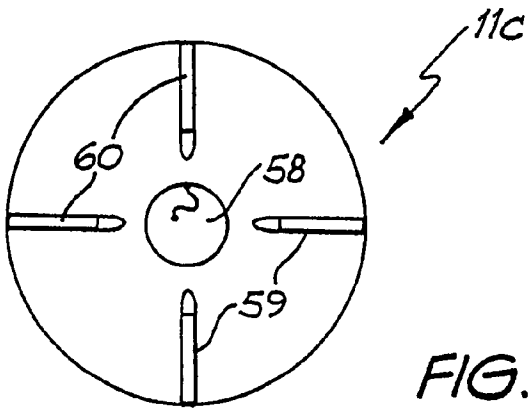
FIG. 23 is an aft end view of the mortar projectile shown in FIG. 22.
Figure 24:
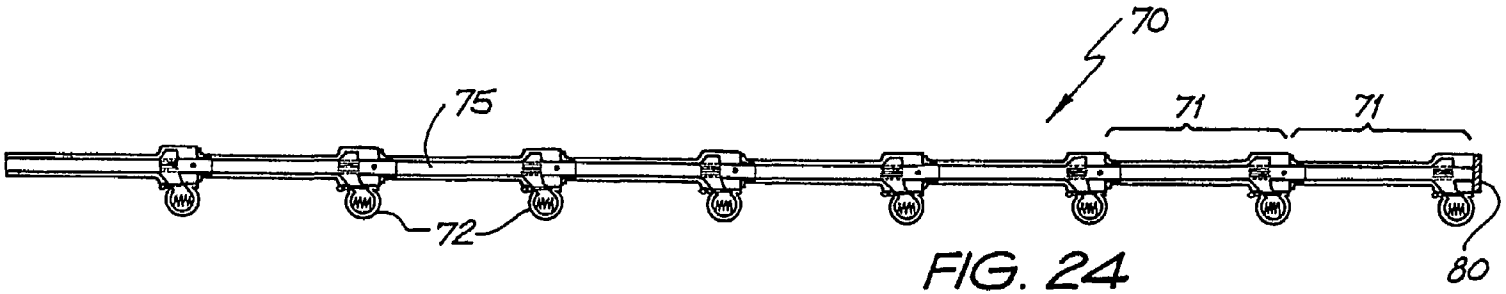
FIG. 24 is a schematic elevational view of a satellite-launch device according to a sixth embodiment of the present invention.
Figure 25:
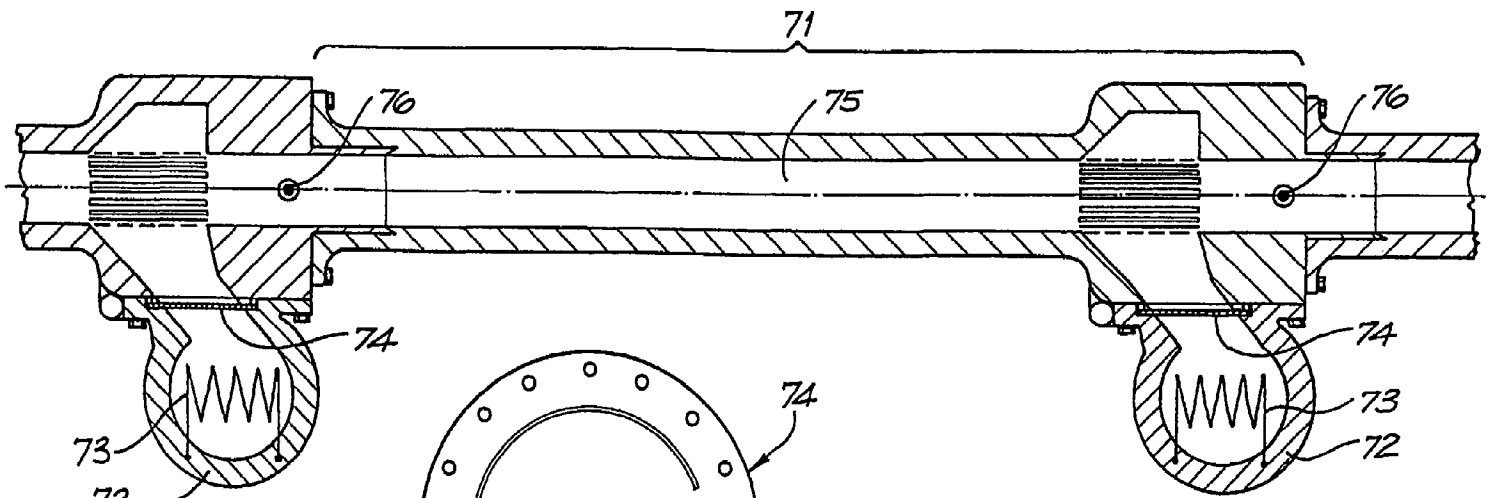
FIG. 25 is a schematic enlarged elevational view of a modular unit of the satellite-launch device shown in FIG. 24.
Figure 26:
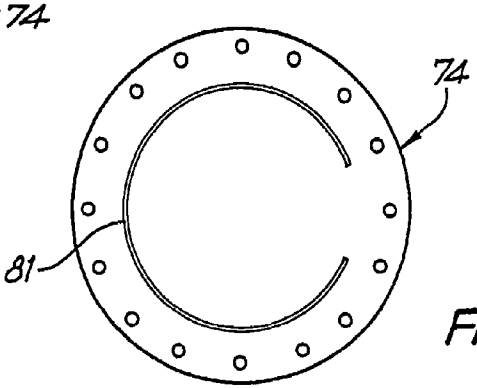
FIG. 26. is an enlarged plan view of a burst disc component of the modular unit shown in is FIG. 25.
Figure 27:
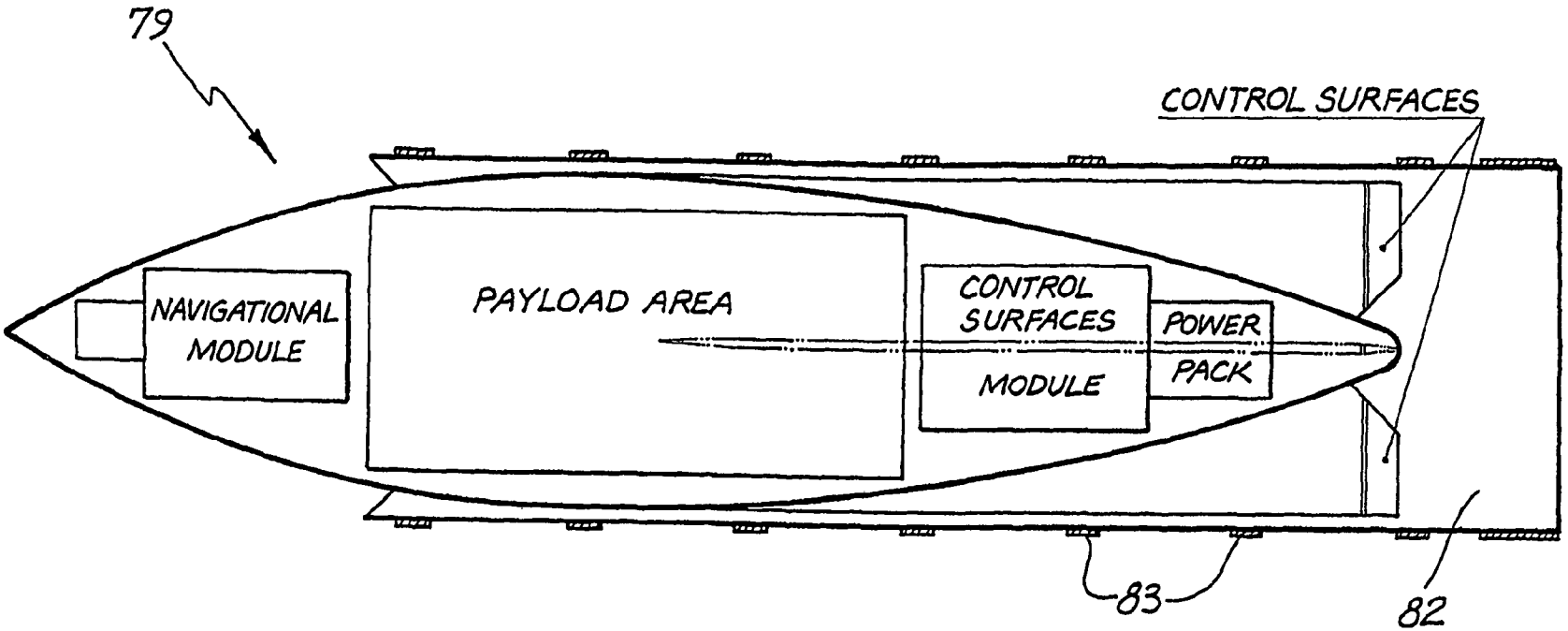
FIG. 27 is an enlarged cross-sectional view of a satellite and carrier to be launched for the satellite-launch device of FIG. 24.

FIG. 11 depicts an artillery/naval gun 31 in accordance with a third embodiment of a projectile firing device of the present invention. The gun 31, like that of rifle 1 of the first embodiment utilizes liquid $CO_2$ which is introduced into a chamber 8 and then heated to ensure a phase change to a "highly dense" gas. In addition to the primary chamber 8, the gun 31 may also be provided with secondary chambers 8*a* and 8*b* that are also loaded with liquid $CO_2$. As a projectile dispatched by the explosive charge of $CO_2$ from the primary chamber 8 passes sensors 17A and 17B associated respectively with secondary chambers 8*a* and 8*b*, gas within those chambers is also released assisting in the dispatch of the projectile. Gun 31 may preferably have a barrel of approximately two meters in length. The firing of the primary chamber 8 followed by assistance to the projectile 11 via secondary chambers 8*a* and 8*b* is able to provide a higher velocity to the projectile 11 than would be achieved with a single chamber 8. As with rifle 1 of the first embodiment it is envisaged that a KEVLAR/aluminum composite could be used, thereby making the gun 31 up to five times the strength of steel for a given weight.

FIGS. 12-15 depict a grenade launcher 41 and ammunition fitted to rifle 1 of the first embodiment in accordance with a fourth embodiment of a projectile firing device of the present invention. In this embodiment the grenade launcher 41 is for launching grenade cartridges 11*a* each of which comprise a fore compartment 42, and aft compartment 43 and a central compartment 44 therebetween. The fore compartment 42 contains a detonator 45 and high explosive 46, the central compartment 44 contains a charge of liquid $CO_2$, and aft compartment 43 comprises of a magnesium compound thermal detonator. The fore compartment 42 is adapted to readily separate from central compartment 44.

In this embodiment the grenade launcher 41 utilises a heating element (not shown) operably connected to electrical battery power supply 14 or 14*a* of rifle 1, which is activated by trigger mechanism 6. The heating element is used to heat the aft compartment (magnesium compound thermal detonator) 43 of a grenade cartridge 11*a* in the loaded position. The heat generated by the magnesium compound thermal detonator is sufficient to ensure that the liquid $CO_2$ undergoes a phase change to a "highly dense" gas, thereby providing explosive energy that destructs central compartment 44 and separates fore compartment 42 therefrom, and expelling the fore compartment 42 containing detonator 45 and high explosive 46 as a projectile from grenade launcher 41 via its barrel 2*a*. The grenades cartridges 11*a* are carried by a carousel-magazine 47.

FIG. 16 to 23, depict a mortar launcher 51 and mortar projectiles 11*c* in accordance with a fifth embodiment of a projectile firing device of the present invention. The mortar launcher 51 may typically be constructed of an aluminum/KEVLAR compose and comprise a high energy output battery pack 14*b*, electronic inclinometer, GPS and compass display 16*b* for accurate targeting, and a lightweight adjustable stand 52. Up to 70% weight saving can be achieved by using the aluminum/KEVLAR composite materials to provide infantry with a more mobile mortar support facility. The tubular body of launcher 51 has an aluminum honeycomb central section 63 "sandwiched" between an inner KEVLAR section 64 and an outer KEVLAR section 62.

The mortar projectile 11*c* is a high explosive pre-shrapnel projectile comprising a front section 53 and a rear section 54. The front section 53 may be manufactured from steel containing high explosive 55 surrounded by pre-fragmented steel particles 56 (which can be replaced by magnesium composite to produce an incendiary device) and a detonator 57. The detonator 57 can be adjusted with a pre-set timer to detonate in-flight or upon impact.

The rear section 54, which may also be manufactured from steel, contains liquid $CO_2$. This rear section also houses a magnesium-oxide composite with a soft metal failure diaphragm 58 and four stability fins 59 with copper tipped electrodes. Surrounding the front and rear sections 53 and 54 are two nylon collar bands, coated with TEFLON or TEFLON impregnated with carbon.

The mortar launcher 51 typically set up and levelled by the use of adjustable support legs of stand 52. Angle of incline and positioning; adjusted by use of front support 52*a*, by the user referring to electronic inclinometer, GPS and compass display 16*b* mounted on the barrel. A laptop or hand-held computer could be used in conjunction with GPS and a Terrain Mapping program to calculate and pinpoint accuracy, and would be advantageous for "Terrain Impaired" hidden targets.

The projectile 11*c* is dropped into the top of the barrel 2*c* of launcher 52 and falls to its base. The fins 59 of projectile 11*c*, equipped with copper tipped electrodes 60, strike the electrode segments 61 situated at the base of launcher 51, making an electrical circuit as the electrode segments are operably connected to battery pack 14*b*. This ignites the magnesium-oxide composite (magnesium burns at 650° C.), superheating the liquid $CO_2$ making a supercritical substance (highly dense gas) at very high pressure. At a predetermined pressure, e.g. about 1350 bar, the soft metal diaphragm 58 fails. So as not to contaminate the base of launcher 51, the diaphragm 58 has a steel cable connected to it so it stays with the projectile.

A rapid rise in pressure takes place flaring the nylon collar bands to promote a good gas seal and to prevent a metal-to-bore contact. The projectile 11*c* is expelled. As projectile 11*c* leaves the bore of launcher 51, approximately 50% of the supercritical $CO_2$ has been utilised. The remainder now acts as the propellent, further accelerating the projectile.

The estimated projectile cycle time for launcher 51 is 4 seconds.

An ammunition box of approximately twenty projectiles 11*c* would also hold a spare high output battery pack 14*b*. One fully charged battery 14*b* would preferably be sufficient to expel 100 projectiles.

The projectile firing device of the present invention can also be used to launch commercial and military satellites or payloads at low cost into low earth orbit (LEO). Prior technologies have previously produced a launching system to put satellites into LEO. One system has launched a probe to an altitude of 180 km and another system has not bettered this result.

When a satellite circles close to the earth it is known as low earth orbit (LEO). Satellites in LEO are 320-800 km (200-500 miles) high and circle the earth in approximately 90 minutes at a speed of 24, 360 kph (17,000 mph).

To launch a LEO satellite the projectile needs to attain a velocity of 7920 metres per second (5 miles per second) when leaving the barrel or launch tube. The projectile firing device of the present invention can achieve this by accelerating a projectile in a rapid sequence by employing a number of independent liquid to gas $CO_2$ chambers in a chain reaction.

FIGS. 24-27 depict a satellite-launch device 70 for launching a LEO projectile 79 into a low earth orbit in a sixth embodiment of a projectile firing device of the present invention. Launcher 70 comprises a plurality of modular units 71, typically eight or more such units. In this preferred embodiment, eight modular units each of about eight metres in length are used. Each unit 71 comprises a $CO_2$ vessel 72, heating element 73, explosive activated burst disc 74, a smooth barrel bore 75, an electronic projectile location sensor 76 and an electronic control unit (ECU) 77.

Each high pressure $CO_2$ vessel 72 contains a metered amount of liquid $CO_2$. A heating element 73 is incorporated to heat the liquid $CO_2$ to a pressure in excess of 4000 bar. Its associated burst disc 74 is attached, sealing the pressure vessel from the bore 75. The burst disc 74 has a fault machined into it; the fault is filled with a shaped high explosive charge to enable an extremely rapid release of the highly dense gasified and super-heated $CO_2$.

A bore 75 of each modular unit 71 is smooth to reduce friction. Electronic sensors 76 are located within the launcher bore 75 to detect and monitor a projectile 79 within the launcher 70. The ECU 77 is used monitor and control the launch of a projectile 79.

In use a LEO projectile 79, which in this embodiment is about four metres in length and about one metre in diameter, is placed into breech 80 at one end of launcher 70, and then breech 80 is then sealed. Projectile 79 is carried by a carrier 82, having a plurality of low friction bands 83. All pressure vessels 72 are then charged with liquid $CO_2$ with burst discs 74 in place. The liquid $CO_2$ is heated until the required pressure is obtained to induce a phase change to "highly dense" gas. The pressure vessel 72 closest to breech 80 is then released which pushes the projectile 79 up the bore at high velocity. The projectile 79 is sensed by sensor(s) 76 in the second adjacent modular unit 71 and then the second stage is activated releasing $CO_2$ in the next stage. As projectile 79 is moving through the bore 75 so fast, a very quick response mechanism is required to release the high pressure $CO_2$. A C-shaped explosive charge 81 is required to fracture the burst disc 74 and release the $CO_2$ gas at high volume and high speed. The process is a very rapid deployment of projectile 79 from launcher 70.

It should be understood that whilst $CO_2$ has been selected as the preferable propellant due to its properties and commercial availability, other liquid/gaseous propellants could be used in alternative embodiments.

The term "comprising" as used herein is used in the inclusive sense of "including" or "having" and not in the exclusive sense of "consisting only of".

The invention claimed is:

1. A projectile firing device comprising:

an elongate barrel;

loading means for introducing a projectile into said barrel;

holding means for holding a supply of compressed gas propellant in a liquid state; and heating means for heating said supply of compressed gas propellant in a liquid state, to induce a phase change in said propellant to convert said propellant into a supercritical fluid, said holding means being arranged to hold said propellant to dispose it, once converted into said supercritical fluid, to act directly on a said projectile in said barrel to propel the projectile through said barrel.

2. A projectile firing device as claimed in claim 1, further comprising:

at least one chamber constituting said holding means;

valve means disposed so that said at least one chamber is in fluid communication with said barrel via the valve means;

a reservoir located remote from said at least one chamber for storing said compressed gas propellant in a liquid state; and a means for introducing said compressed gas propellant in a liquid state from said reservoir into said at least one chamber, wherein said valve means is operable to release said propellant, after it is converted into said supercritical fluid, from said at least one chamber into said barrel to enable the supercritical fluid to act directly on a projectile in the barrel to propel the projectile through the barrel.

3. A projectile firing device as claimed in claim 1 or 2, wherein said device is a weapon including a rifle, gun or pistol.

4. A projectile firing device as claimed in claim 1, wherein said loading means is for introducing a cartridge into said barrel, with a said projectile being housed within said cartridge, said cartridge containing a reservoir of said compressed gas propellant in a liquid state and a thermal detonator adjacent thereto, said loading means being arranged to position said cartridge in said barrel so that the thermal detonator is in proximity to said heating means to enable the heating means to heat said thermal detonator to cause the detonator to heat said propellant.

5. A projectile firing device as claimed in claim 4, wherein said device is a weapon including a grenade launcher.

6. A projectile firing device as claimed in claim 1, wherein said loading means is for introducing a cartridge into said barrel, with a said projectile being housed within said cartridge, said cartridge containing a reservoir of said compressed gas propellant in a liquid state and said heating means being integral with said cartridge.

7. A projectile firing device as claimed in claim 6, wherein said cartridge holds a sufficient amount of said compressed gas propellant in a liquid state to enable a portion of the propulsive energy of said propellant, after it is converted into said supercritical fluid, to continue acceleration of the projectile for a period of time after the projectile has left said barrel.

8. A projectile firing device as claimed in claim 7, wherein said device is a weapon including a mortar launcher.

9. A projectile firing device as claimed in claim 1 or 2, wherein said device is a satellite launching device and said projectile is a low earth orbit satellite.

10. A projectile firing device as claimed in claim 9, wherein said device comprises a plurality of modular units and a plurality of chambers.

11. A projectile firing device as claimed in claim 10, wherein each chamber is associated with a respective modular unit.

12. A projectile firing device as claimed in claim 3, wherein said barrel of said device is made of a composite material.

13. A projectile firing device as claimed in claim 12, wherein said composite material is a synthetic fiber/aluminate laminate.

14. A projectile firing device as claimed in claim 12, wherein said barrel has a polytetrafluoroethylene coated bore.

15. A projectile firing device as claimed in claim 3, wherein said device is a rifle and it has a body, stock and pistol grip made of plastic.

16. A projectile firing device as claimed in claim 15, wherein said plastic is glass filled nylon.

17. A projectile firing device as claimed in claim 2, further comprising an electronic control unit, which controls an ingress of said propellant in its liquid state from the reservoir to said chamber and controls the heating means used to heat said propellant.

18. A projectile firing device as claimed in claim 17, further comprising targeting means for targeting said projectile and said electronic control unit is operably connected to said targeting means to control the ingress of aid propellant to said chamber and to control the heating means used to heat said propellant in response to varying targeting parameters including a distance and altitude of the device.

19. A projectile firing device comprising:

an elongate barrel;

loading means for introducing a projectile into said barrel;

a reservoir for storing a compressed gas propellant in a liquid state;

at least one chamber, remote from said reservoir, for receiving compressed gas propellant in a liquid state from said reservoir;

heating means for heating said compressed gas propellant in a liquid state in said at least one chamber to induce a phase change in said propellant to convert it into a supercritical fluid; and valve means, wherein said at least one chamber is in fluid communication with said barrel via said valve means, which is operable to release said supercritical fluid from said at least one chamber to enable said fluid to act directly on a projectile in said barrel to propel the projectile through the barrel.

20. A projectile firing device as claimed in claim 1, wherein said propellant is carbon dioxide.

21. A projectile firing device as claimed in claim 1, wherein the heating means is powered by an electrical battery to heat the liquid into the supercritical fluid.

22. A projectile firing device as claimed in claim 19, wherein the heating means is powered by an electrical battery to heat the liquid into the supercritical fluid.

23. A projectile firing device as claimed in claim 1, wherein the heating means is adapted to said compressed gas propellant to induce a said phase change without combustion of the propellant, to enable the supercritical fluid to propel the projectile through said barrel with minimal noise and with no heat signature.

24. A projectile firing device as claimed in claim 19, wherein the heating means is adapted to said compressed gas propellant to induce a said phase change without combustion of the propellant, to enable the supercritical fluid to propel the projectile through said barrel with minimal noise and with no heat signature.

* * * * *